United States Patent [19]

Cardinale

[11] Patent Number: 4,864,084

[45] Date of Patent: Sep. 5, 1989

[54] MEMBRANE-TYPE TOUCH PANEL

[75] Inventor: Emanuel Cardinale, Sag Harbor, N.Y.

[73] Assignee: C.A.M. Graphics, Co., Inc., Amityville, N.Y.

[21] Appl. No.: 157,255

[22] Filed: Feb. 18, 1988

[51] Int. Cl.[4] ..... H01H 9/26

[52] U.S. Cl. ..... 200/5 A

[58] Field of Search ..... 200/5 A, 86 R, 159 B

[56] References Cited

U.S. PATENT DOCUMENTS 3,732,384 5/1973 Fischel ..... 200/86 R 4,382,165 5/1983 Balash et al. ..... 200/159 B

*Primary Examiner*—Roy N. Envall, Jr.

*Attorney, Agent, or Firm*—Steinberg & Raskin

[57] ABSTRACT

In a membrane-type touch panel including a pair of circuit layers having facing conductive circuit patterns normally separated by spacers defining voids through which regions of the circuit patterns can move to effect actuation, a series of projections are provided which, upon actuation, are adapted to act inwardly upon the outer surface of at least one of the two circuit layers at regions aligned with corresponding voids to reduce the required actuation force or to allow a reduction in the size of the spacer voids to reduce the possibility of false actuations.

9 Claims, 4 Drawing Sheets

MEMBRANE-TYPE TOUCH PANEL

BACKGROUND OF THE INVENTION

This invention relates to pressure-sensitive membrane-type touch panel devices which electrically indicate the X-Y coordinates of contact of an operator's finger or probe or which may be used as switches.

Membrane touch panels of the general type with which the invention is concerned are well known in the art. These touch panels generally include a pair of circuit layers, one fixed and one moveable, separated by spacer means. The circuit layers comprise sheets of insulating material which have conductive circuit patterns provided thereon. In some analog applications, the circuit patterns may comprise continuous layers of conductive material provided over the surfaces of the respective circuit layers. In any case, these circuit patterns face each other and are separated by spacer means formed of insulative material, which may comprise insulative dot spacers, a separate insulative layer in which apertures are formed, a grid pattern formed of insulative material, and the like. Electrical switching is effected by applying finger or other pressure to specific locations of one of the circuit sheets to move a contact element, i.e. a region of the circuit pattern, on that circuit sheet through a void of the spacer means, e.g., through the region between adjacent dot spacers or through an aperture of an apertured spacer layer, to make contact with a contact element on the other circuit sheet. Touch panels of this type are generally formed in a laminate construction with the layers bonded together. The panel may also include one or more of an overlay sheet with graphics or the like, a layer adapted to be electrically charged during operation to provide EMI shielding, and a backer plate to support the touch panel. The backer plate may comprise a CRT screen in which case the layers of the touch panel are made of transparent material.

Membrane-type touch panels of the type described above may find applications in conditions of varying temperature and humidity. Extended use under such environmental conditions, or even advancing age of the touch panel itself, may cause circuit layers to become warped to a greater or lesser degree. This becomes a problem when the warping is so great that a circuit element on the warped circuit layer becomes situated in a void of the spacer means and contacts a circuit element on the other circuit layer in which case a false actuation of the panel occurs. Attempts have been made to overcome this problem by modifying the size of the voids of the spacer means. For example, in the case where the spacer means comprise dot spacers, the distance between the dot spacers has ben reduced in an attempt to prevent false actuations. However, any reduction in the distance between the dot spacers results in a corresponding increase in the force required for the operator to actuate the touch panel switch. Since maximum allowable actuation forces are usually specified, this method of preventing false actuations has to the present not been practical in all cases. Indeed, the distance between the dot spacers may be reduced to the point where actuation of the touch panel becomes impossible.

It is also seen from the foregoing that the force required to actuate a membrane touch switch, as noted above, depends to some extent on the size of the voids of the spacer means which maintain the separation of the opposed circuit patterns. For example, in touch panels where the spacer means comprise an insulative apertured layer provided between the circuit layers, the diameter of the apertures directly affects the magnitude of the force required for actuation. Similarly, in touch panels where the spacer means comprise dot spacers, the distance between the dots has a direct affect upon the magnitude of the actuation force. Increasing the diameter of the apertures of a spacer layer or the distance between dot spacers, i.e., increasing the lateral dimensions of the voids of the spacer means, on the one hand, decreases the required actuation force, but, on the other hand, increases the possibility of false actuations by making it easier for opposed regions of the facing circuit patterns to inadvertently contact each other.

SUMMARY OF THE INVENTION

Accordingly, it is an object of the present invention to provide new and improved membrane-type touch panels.

Another object of the present invention is to provide new and improved membrane-type touch panels where the possibility of false actuations is mimimized while the force necessary for actuation is maintained within acceptable ranges.

Still another object of the present invention is to provide new and improved membrane-type touch panels wherein the actuation force can be selectively varied without changing the design of the spacer means which normally maintain the opposed circuit patterns in spaced relationship with each other.

Briefly, in accordance with the present invention, these and other objects are obtained by providing a touch panel with a series of projections which are adapted to act, upon initiation of the actuation of the touch panel, inwardly upon the outer surface of at least one of the two circuit layers at regions aligned with corresponding voids of the spacer means. For example, the projections may be provided on the outer surface of an additional layer overlying the moveable or dynamic circuit layer, or may be provided on an additional layer backing the normally static circuit layer, or may be provided on the outer surface on one or both of the circuit layers themselves. It has been found that by such provisions, the lateral dimensions of the voids of the spacer means can be reduced thereby reducing the possibility of false actuations of the touch panel while at the same time maintaining the magnitude of the actuation force within permissible values. By the same token, the provision of projections in accordance of the invention in a touch panel having spacer means whose voids are of a given dimension results in a reduction of the force required for actuation of the touch panel.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
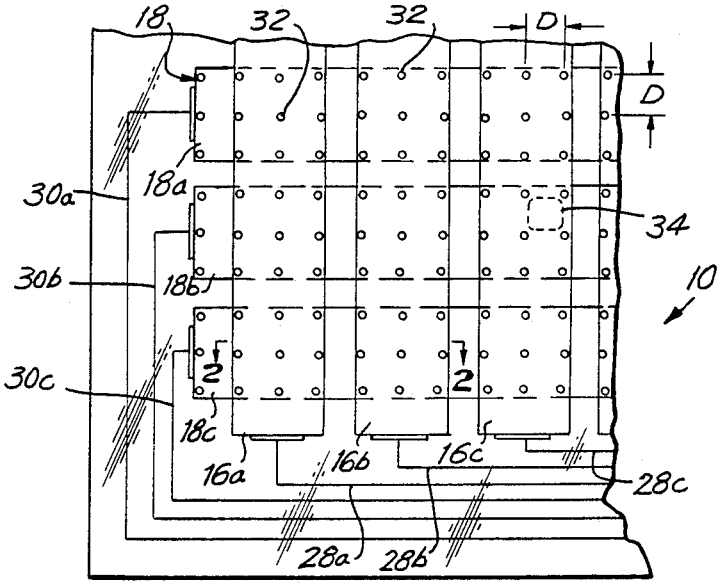
FIG. 1 PRIOR ART
FIG. 1 is a partial plan view of one embodiment of a conventional membrane-type touch panel.
Figure 2:
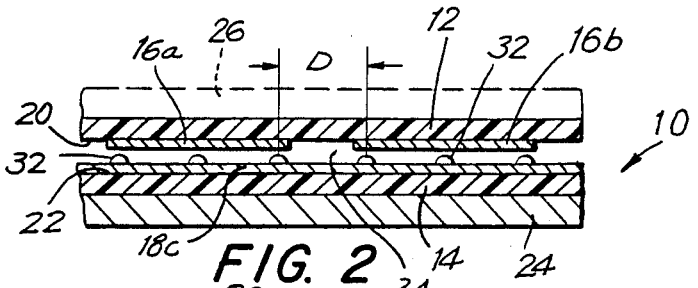
FIG. 2 PRIOR ART
FIG. 2 is a section view of the conventional membrane touch panel of FIG. 1 taken along line 2—2 thereof.
Figure 3:
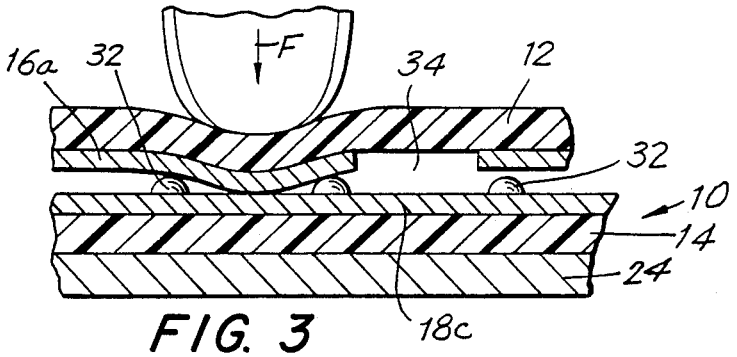
FIG. 3 PRIOR ART
FIG. 3 is a view illustrating the conventional touch panel of FIG. 2 upon actuation.

Referring first to FIGS. 1–3, a corner portion of a conventional membrane touch panel 10 in accordance with the prior art is shown (FIG. 1). The touch panel comprises a first or dynamic circuit layer 12 bonded along its periphery to a second or static circuit layer 14. Opposed first and second circuit patterns 16 and 18 are provided respectively on the facing inner surfaces 20 and 22 of first and second circuit layers. The circuit layers 12 and 14 are formed of flexible insulative sheet material such as polyester generally having a thickness in the range of between about 0.003 to 0.100 inches. The first and second circuit patterns each comprise a series of conductive strips 16*a*, 16*b*, 16*c*,... and 18*a*, 18*b*, 18*c*, ... firmly adhering to the inner surfaces 20, 22 of circuit layers 12, 14 and running orthogonally to each other. The conductive strips may be formed of indium oxide, tin oxide or a combination of both oxides and are deposited on the surfaces of the circuit layers by standard techniques, such as by coating the entire inner surface of each circuit layer with the conductive material and then forming gaps between adjacent strips by a standard etching technique using photo-resist material. In the illustrated embodiment, the touch panel includes a backing plate 24 which may comprise an EMI shield. An optional overlay sheet 26 may also be provided. In a typical application, the touch panel 10 may be applied over a CRT screen in which case the various layers and circuit patterns are formed of transparent material as shown. Leads 28*a*, 28*b*, 28*c*, ...; 30*a*, 30*b*, 30*c*, ... are attached to the ends of the strips of circuit patterns 16, 18 so as to make electrical contact between them and external support electronics.

Spacer means are provided in order to normally maintain the circuit patterns 16, 18 separated from each other but able to contact each other when actuated by finger or other pressure applied to the dynamic circuit layer 12. In the illustrated embodiment, the spacer means comprise a matrix of dot spacers 32 uniformly arranged over the circuit pattern 18. Dot spacers 32 are of substantially equal height generally in the range of between about 0.0005 to 0.100 inches and are formed of insulative material applied by conventional techniques, such as by screening or air-jet spraying. Adjacent dot spacers 32 are spaced from each other by a lateral distance D to form inter-dot voids 34 therebetween. A typical void 34 is indicated in phantom in FIG. 1. Although the dot spacer matrix of the illustrated embodiment is a uniform matrix (the distance D between two orthogonally adjacent pairs of dot spacers 32 is the same), it is understood that this is not essential and, in fact, the dot spacers can even be arranged in a random fashion.

In operation, referring to FIG. 3, when it is desired to actuate the touch panel, an actuation force F is applied to the appropriate region of the dynamic circuit layer 12 to flex the same until a contact element, i.e., a region of the first circuit pattern 16, on that circuit layer moves through a void or voids 34 of the spacer means to make contact with an aligned region of the second circuit pattern 18.

As noted above, an object of the present invention is to reduce the possibility of false actuation of a touch panel of the type described above as well as similar touch panels which may be provided with other types of spacer means having spacer voids through which a region of the dynamic circuit layer moves during actuation, by reducing the area of the spacer voids, while maintaining the actuation force within acceptable limits, i.e., while maintaining the actuation force below impractical upper limits.

According to the general principles of the invention, a touch panel of the type described above is provided with a matrix of projections which, upon initiation of an actuation force F, are adapted to act inwardly upon the outer surface of at least one of the first and second circuit layers 12 and 14 at a region aligned with corresponding voids 34 of the spacer means.

Figure 4:
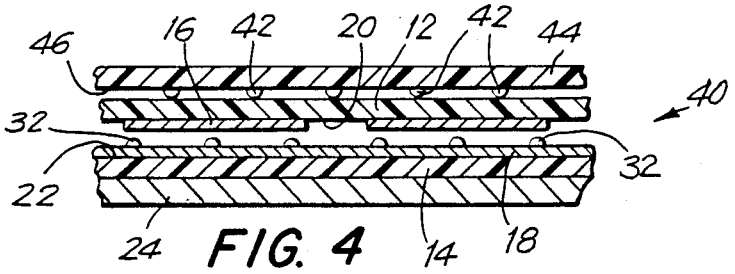
FIG. 4 is a section view similar to FIG. 2 showing one embodiment of a membrane touch panel in accordance with the present invention.
Figure 5:
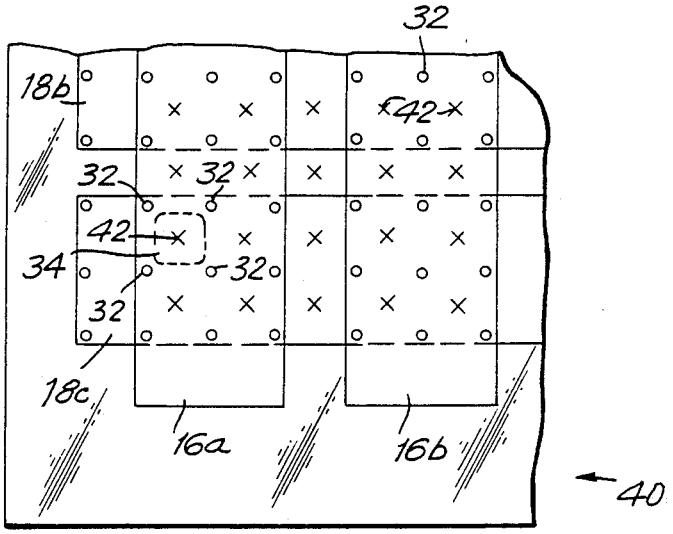
FIG. 5 is a partial plan view of the membrane touch panel shown in FIG. 4.
Figure 6:
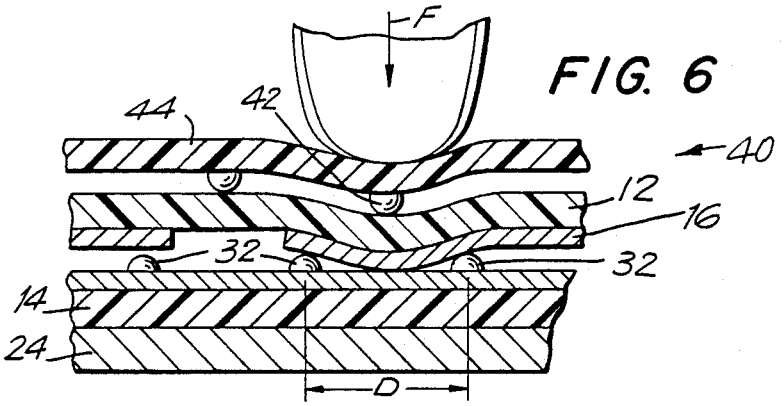
FIG. 6 is a schematic illustration showing the membrane touch panel of FIGS. 4 and 5 upon actuation.

Referring to FIGS. 4–6, a first embodiment 40 of a touch panel according to the invention will now be described. Elements of touch panel 40 which are the same as corresponding elements of touch panel 10 will be designated by the same reference numerals. In this embodiment, projections in the form of dot-projections 42 are provided on the surface of an overlay sheet 44 which overlies the dynamic circuit layer 12.

More particularly, an overlay sheet 44 is provided which may be formed of the same material as circuit layers 12 and 14 and is bonded along its periphery over circuit layer 12. A matrix of dot-projections 42 of substantially equal height, e.g. in the range of between about 0.002 and 0.100 inches, are uniformly arranged over the inner surface 46 of overlay sheet 44. The dot-projections 42 may be formed of the same material as dot spacers 32 and may be applied to the overlay sheet 26 in the same manner as the dot spacers are applied to the circuit layer. As best seen in FIG. 5 (wherein each dot-projection 42 is schematically shown by an "x"), the dot-projections 42 are provided on the overlay sheet 44 at regions which are aligned which, i.e. which overlie, corresponding voids 34 defined by the dot spacers 32.

In operation, referring to the schematic illustration of FIG. 6, when an actuation force F is applied to the outer surface of the overlay sheet 44, a dot projection 42 acts inwardly upon the outer surface of the first circuit layer 12 at a region overlying a corresponding spacer void 34 and functions to localize the actuation force to enhance the flexing of the first circuit layer 12 to enable a region of the first conductive pattern 16 to electrically engage the underlying region of the second circuit pattern 18 with a lesser actuation force F being required than in the case where the dot-projection is not provided and the distance D between dot spacers 32 is the same. This in effect allows the distance D to be reduced thereby minimizing the possibility of false actuation due, for example, to warping of circuit layer 12, while retaining the actuation force F within acceptable limits.

Figure 7:
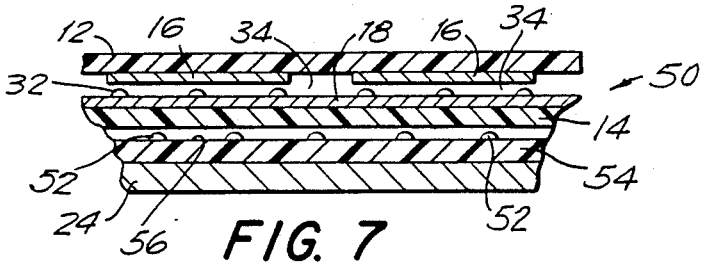
FIG. 7 is a section view similar to FIGS. 2 and 4 showing a second embodiment of a membrane touch panel in accordance with the invention.
Figure 8:
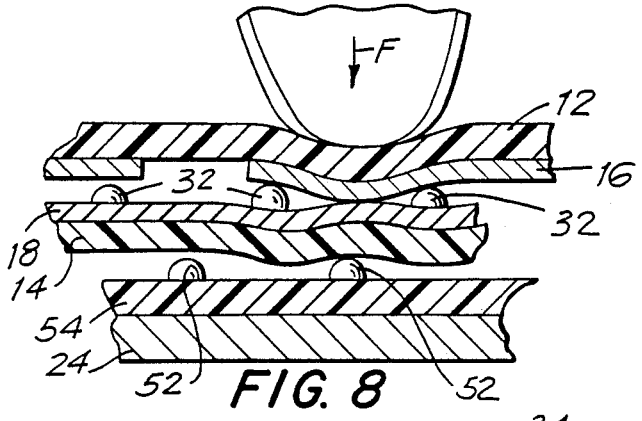
FIG. 8 is a schematic illustration showing the membrane touch panel of FIG. 7 upon actuation.

Referring to FIGS. 7 and 8, a second embodiment of a touch panel according to the invention is illustrated and elements thereof which are the same as corresponding elements of touch panel 10 will be designated by the same reference numerals. In this embodiment, projections in the form of dot-projections 52 are provided on a surface 56 of an intermediate back layer 54 which is situated between the second circuit layer 14 and the backing plate 24. The back layer 54 may be formed of the same material as circuit layers 12 and 14 and is bonded along its periphery to the underside of second circuit layer 14. A matrix of dot-projections 52 of substantially equal height, e.g. in the range of between about 0.002 to 0.100 inches, are uniformly arranged over the inner surface 56 of back layer 54. The dot-projections 52 may be formed of the same material as dot spacers 32 and may be applied to the surface 56 of back layer 54 in the same manner as the dot spacers are applied to the circuit layers. The dot-projections 52 are provided on the back layer 54 at locations which are aligned with, i.e., which overlie, corresponding voids 34 defined by the dot spacers 32. In this connection, a plan view of the touch panel 50 (assuming transparent circuit layers and circuit patterns) will appear similar to the illustration of FIG. 5.

In operation, referring to the schematic illustration of FIG. 8, when an actuation force F is applied to the first circuit layer 12, the force is transmitted through spacer dots 32 to the second circuit layer 14. A dot-projection 52 acts upwardly upon the outer surface of the second circuit layer 14 at a region overlying a corresponding spacer void 34 and functions to apply an inwardly directed and localized force thereto to flex the second circuit layer towards the first circuit layer to enable regions of the circuit patterns 16 and 18 to electrically engage each other. Again, a smaller actuation force F is thereby required then in the case where the dot-projections are not provided and the distance D between adjacent dot spacers is the same.

Figure 9:
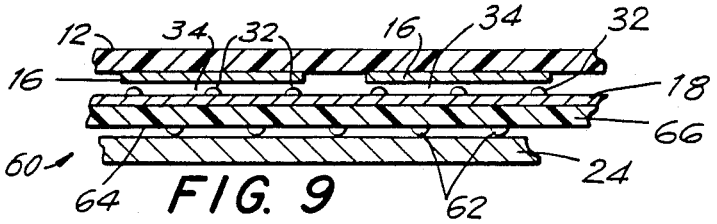
FIG. 9 is a section view similar to FIGS. 2, 4 and 7 showing a third embodiment of a membrane touch panel in accordance with the invention.
Figure 10:
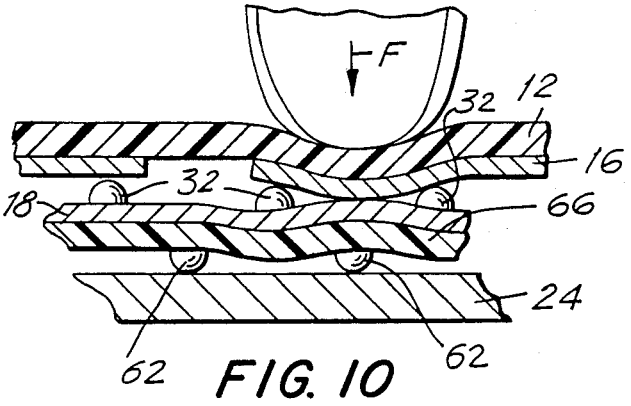
FIG. 10 is a schematic illustration showing the membrane touch panel of FIG. 9 upon actuation.

Referring to FIGS. 9 and 10, a third embodiment 60 of a touch panel according to the invention is illustrated and elements thereof which are the same as corresponding elements of touch panel 10 will be designated by the same reference numerals. In this embodiment, projections in the form of dot-projections 62 are provided on the outer surface 64 of the second circuit layer 66. In particular, a matrix of dot-projections 62 of substantially equal height, e.g., in the range of between of about 0.002 to 0.100 inches, are uniformly arranged over the outer surface 64 of second circuit layer 66. The dot-projections 62 may be formed of the same material as dot spacers 32 and may be applied to the surface 64 of second circuit layer 66 in the same manner as the dot spacers are applied to the inner surface thereof. The dot-projections 62 are provided on the outer surface 64 of second circuit layer 66 at locations which are aligned with, i.e., which overlie, corresponding voids 34 defined by the dot spacers 32.

In operation, referring to the schematic illustration of FIG. 10, when an actuation force F is applied to the first circuit layer 12, the force is transmitted through spacer dots 32 to the second circuit layer 66. A dot projection 62 is thereby urged against backing plate 24 so that an opposite force acts inwardly upon the outer surface of the second circuit layer 66 at a region overlying a corresponding spacer void 34. This has the affect of applying an inwardly directed and localized force to the second circuit layer to thereby flex the same towards the first circuit layer to enable regions of the circuit patterns 16 and 18 to electrically engage each other. Again, a smaller actuation force F is thereby required then in the case where the dot-projections are not provided and the distance D between the dot spacers is the same.

Figure 11A:
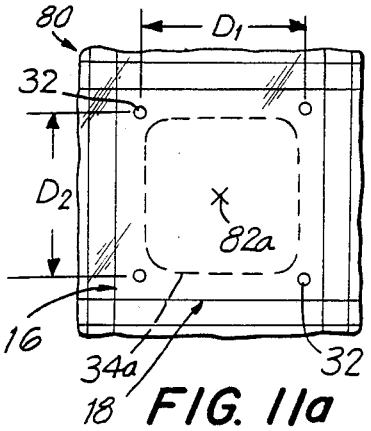
FIGS. 11*a*–11*d* are partial plan views of an experimental membrane touch panel used for testing purposes.
Figure 11B:
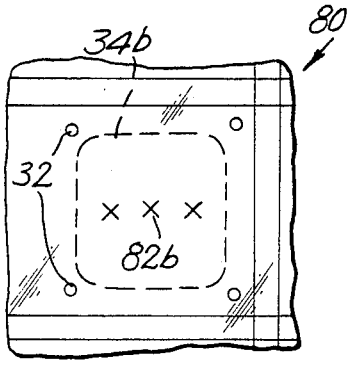
Figure 11C:
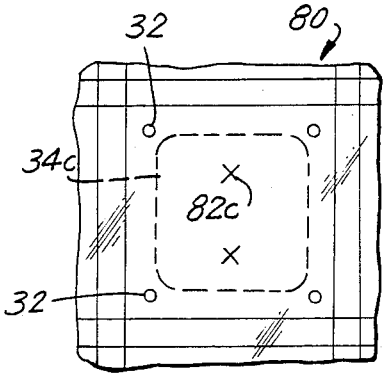
Figure 11D:
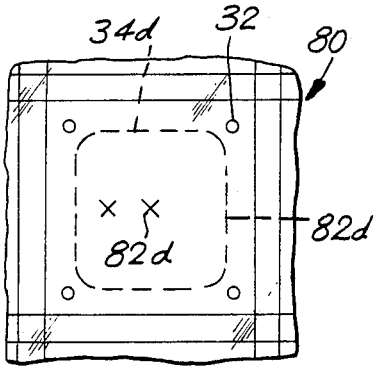

Turning now to FIGS. 11*a*–11*d*, portions of an experimental touch panel 80 are illustrated which was used in tests to determine the magnitude of the reduction of the force required to actuate the touch panel as a function of the number and pattern of dot-projections 82 overlying the voids 34 defined by dot spacers 32 of the touch panel. The touch panel 80 was constructed according to the embodiment of FIG. 9, i.e. with dot-projections 82 provided on the outer surface of the second circuit layer. The distances $D_1$ and $D_2$ between the dot spacers 32 defining the voids 34 were uniform and equal to 0.100 and 0.090 inches respectively. The circuit layers were formed of polyester sheet material having a thickness of 0.007 inches and height of the dot spacers 32 was 0.0007 inches. Different patterns of dot-projections 82 (schematically shown as "x's") were aligned with respective voids 34*a*–34*d* as illustrated in FIGS. 11*a*–11*d* respectively. In particular, a single centrally located dot-projection 82*a* was aligned with the void 34*a* (FIG. 11*a*). Three dot-projections 82*b* (FIG. 11*b*) arranged in the direction of circuit pattern strips 18 overlie the void 34*b*. A pair of dot projections 82*c* (FIG. 11*c*) arranged in the direction of circuit pattern strips 16 overlie void 34*c* and a pair of dot-projections 82*d* (FIG. 11*d*) arranged in the direction of circuit pattern strips 18 overlie void 34*d*. Tests were also run on a conventional touch panel, i.e. a touch panel which did not include the projections 82 in accordance with the invention, but which was otherwise the same as touch panel 80. In the case of the conventional touch panel, an average actuation force of about 21 ounces was required to actuate the switch. The tests conducted established that the actuation force was indeed reduced by the provision of the dot-projections 82 according to the invention. In particular, an average actuation force of about 18.0 ounces was required to actuate the touch panel in the region of void 34*a* (FIG. 11*a*), an average actuation force of about 4.9 ounces was required to actuate the touch panel in the region of void 34*b* (FIG. 11*b*), an average actuation force of about 7.7 ounces was required to actuate the touch panel in the region of void 34*c* (FIG. 11*c*) and an average actuation force of about 9.6 ounces was required to actuate the touch panel in the region of void 34*d*. It is seen from the foregoing that the magnitude of the actuation force is in fact reduced by the provision of the projections in accordance with the invention and that the extent of such reduction, depends, among other things, on the pattern and number of projections provided overlying the voids in the respective regions of the touch panel.

Obviously, numerous modifications and variations of the present invention are possible in light of the above teachings. For example, projections may be provided which act upon both of the circuit layers upon actuation of the touch panel. The projections need not act directly on the circuit layers, but may, for example, act on the circuit layers through an intermediate layer. The spacer means may take a form other than dot spacers and the projections may take a form other than dot-projections within the scope of the invention. Other modifications and variations are of course possible. It is therefore to be understood that within the scope of the claims attached hereto, the invention may be practiced otherwise than as specifically disclosed herein.

What is claimed is:

1. A membrane-type touch panel, comprising:

a first circuit layer;

a first circuit pattern provided on said first circuit layer with said first circuit pattern being supported over substantially its entire area by said first circuit layer;

a second circuit layer;

a second circuit pattern provided on said second circuit layer facing said first circuit pattern, said second circuit pattern being supported over substantially its entire area by said second circuit layer;

substantially non-deformable spacer means for normally separating said first and second circuit patterns, said spacer means defining a plurality of void means for permitting a corresponding plurality of regions of said first and second circuit patterns aligned with respective void means to move into electrical engagement with each other upon actuation of said touch panel; and projection means for applying an inwardly directed and localized force upon the outer surface of at least one of said first and second circuit layers upon initiation of an actuation force on said touch panel, said projection means being aligned with corresponding void means defined by said spacer means.

2. The combination of claim 1 wherein said touch panel includes an overlay sheet overlying said first circuit layer and wherein said projection means are formed on said overlay sheet and are adapted to act on said first circuit layer.

3. The combination of claim 1 wherein said touch panel includes a back layer overlying said second circuit layer and wherein said projection means are formed on said back layer and are adapted to act on said second circuit layer.

4. The combination of claim 1 wherein said projection means are formed on an outer surface of said second circuit layer and are adapted to act thereon.

5. The combination of claim 1 wherein said spacer means comprise dot spacers.

6. The combination of claim 1 wherein said projection means comprise dot-projections.

7. The combination of claim 1 wherein said spacer means comprise dot spacers and said projection means comprise dot-projections.

8. The combination of claim 7 wherein said dot spacers and dot-projections are arranged in uniform patterns.

9. The combination of claim 1 wherein at least one of said projection means are aligned with each void means of said spacer means.

* * * * *